United States Patent [19]

Schmidt

[11] 4,091,573

[45] May 30, 1978

[54] MACHINE FOR GRINDING THE EDGE AREAS OF FORMED PARTS

[75] Inventor: Erich Schmidt, Mauerbach, Austria

[73] Assignee: Maschinenfabrik Zuckermann Komm. Ges., Vienna, Austria

[21] Appl. No.: 774,339

[22] Filed: Mar. 4, 1977

[30] Foreign Application Priority Data

Mar. 5, 1976 Germany ..... 2609199

[51] Int. Cl.[2] ..... B24B 21/02

[52] U.S. Cl. ..... 51/140; 51/145 R; 51/147

[58] Field of Search ..... 51/140, 141, 145, 147

[56] References Cited

U.S. PATENT DOCUMENTS

| | | | |
|---|---|---|---|
| 1,798,421 | 3/1931 | Hitchcock | 51/147 |
| 2,192,240 | 3/1940 | Richardson | 51/147 X |
| 2,334,960 | 11/1943 | Roth | 51/141 X |
| 2,406,689 | 8/1946 | Indge | 51/147 |
| 2,883,800 | 4/1959 | Reaser | 51/145 R X |

FOREIGN PATENT DOCUMENTS

| | | | |
|---|---|---|---|
| 1,064,370 | 8/1959 | Germany | 51/145 R |
| 2,129,360 | 6/1970 | Germany | 51/145 R |

OTHER PUBLICATIONS

*Abrasive Engineering*, "New Products", Revolving Belt Machine . . . , p. 34.

*Primary Examiner*—Harold D. Whitehead
*Assistant Examiner*—Nicholas P. Godici
*Attorney, Agent, or Firm*—Finnegan, Henderson, Farabow & Garrett

[57] ABSTRACT

Disclosed is a machine for grinding edge areas of slab formed parts including a pair of grinding units pivotally supported on opposite sides of a part clamped for rotation. Pressure elements carried by the frame press the grinding belts against the formed part. Means are provided for adjusting the direction of approach of each grinding belt in accordance with the rotational position of the part so that the angles formed by the belt and the formed part as the belt approaches and leaves the formed part are generally equal to one another.

19 Claims, 24 Drawing Figures

Figure 1:
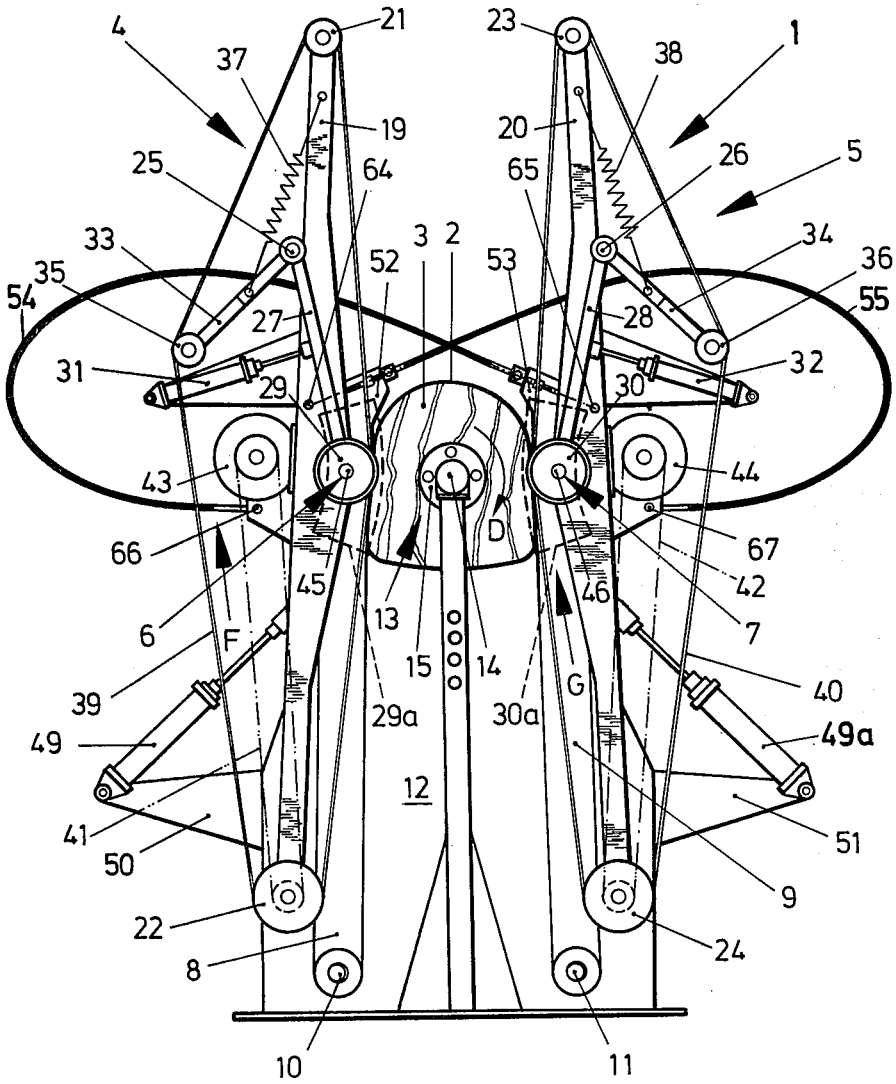

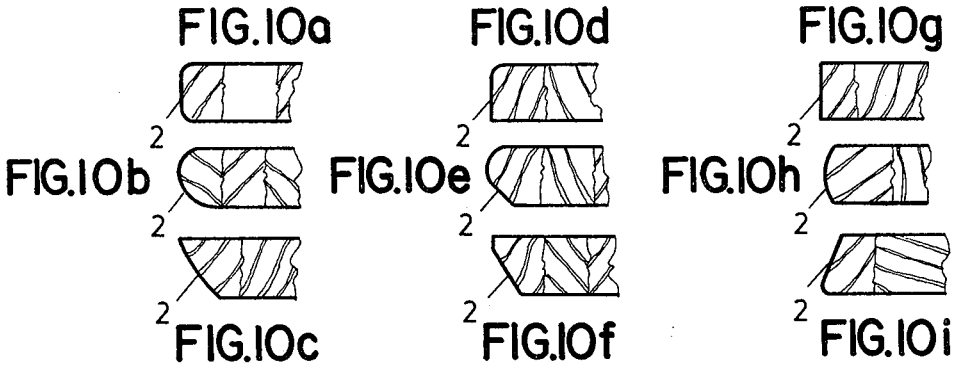
FIG. 8
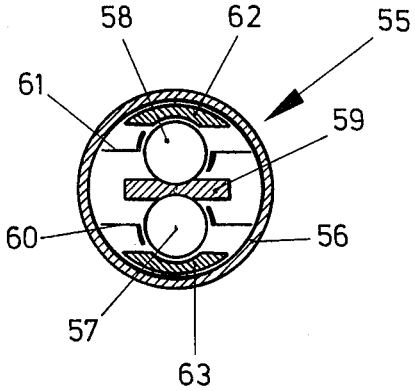

MACHINE FOR GRINDING THE EDGE AREAS OF FORMED PARTS

This invention relates to a machine for grinding the edge areas of slab-shaped formed parts, preferably of wood, for instance seats, by means of a belt grinding unit comprising a grinding belt which is guided over guide rollers and which is adapted to be pressed against said formed part by a pressure element which has a preferably U-shaped, especially elastic guide whose cross section is matched to the edge area to be ground.

A machine of the afore-cited type is already known from practice which serves in particular to grind the edges of table leaves. In the case of the known machine, in which the grinding belt is conducted in a direct line between two reversing rollers, the belt grinding unit is brought into engagement with the formed part in that the formed part is manually moved toward the belt grinding unit and is guided along the same. Only straight edges can be processed with such a machine.

It is also known from practice to machine the edges of formed parts with the aid of grinding drums or grinding brushes or similar soft grinding tools and in this way put rounded chamfers, for example, on the edges. Such machining, however, is very time-consuming and expensive, since it must be executed by hand. Such work is especially critical in the case of large or heavy formed parts.

The object of the present invention is to provide a machine of the afore-stated type, with the aid of which the peripheral edge areas of a formed part can be ground by machine in one work cycle, i.e. in a single mounting.

This object is accomplished in accordance with the invention in that the formed part is clamped in a device which leaves the edge areas free and which enables it to rotate about an axis and the belt grinding unit is mounted at the end portion of a pivotal arm adapted to be pivoted in a plane parallel to the plane of rotation of said formed part so that said belt grinding unit can be pivoted about an axis in the plane of rotation and can be adjusted in the direction of tool approach to correspond to the position of the formed part which is rotated past said pressure element.

In the invention the formed part is clamped so as to be rotatable about an axis. The formed part rotates in order to machine it, thereby causing it to engage with the belt grinding unit in one work cycle along the peripheral edges. This belt grinding unit is mounted to be movable in such a way that it is correspondingly adjusted according to the shape of said formed part. The result is that there is operative engagement between the formed part and the belt grinding unit only in the area of said pressure element respectively. According to the design of the pressure element, e.g. as a pressure shoe or a pressure roller, this may be either line or surface contact. Since the specific relationship between the formed part and the belt grinding unit always exists in the inventive machine, uniform edge processing along the peripheral edges is guaranteed. The double pivotability of the belt grinding unit makes the approach of the belt grinding unit on the course of the peripheral edges possible.

The formed parts to be processed by the machine in accordance with the invention may consist of wood, light-weight metal, plastic or similar materials to be processed with the grinding belt.

A machine of another type is known in practice for processing the edge areas of formed parts in which the formed parts are rotatably clamped on a device. Millers and belt grinding units which can approach the formed part serve to process the edges. These units are mounted to approach the part substantially in a radial direction with respect to the axis of rotation of the formed part and respectively engage the edge of the formed part with the area of the grinding belt which is conducted about the reversing roller. This reversing roller simultaneously acts as a contact roller. The contact roller has a substantially cylindrical design so that straight, right-angled edges can be produced only in cross section with the aid of this known machine.

In a preferred further development of the invention it is provided that the grinding belt moves at an angle less than 180° through the pressure element which is accordingly displaced in an outward direction.

On the basis of this construction, even the processing of formed parts with recoiling edges as exist, for example, in the case of wooden seats for armchairs can be achieved. Since the belt is conducted with a roof-like shape in the area of the pressure element, it is ensured that even when processing recoiling edge areas the belt grinding unit makes operative engagement only in the area of the pressure element, i.e. in the supported area of the grinding belt.

In conjunction with the roof-shaped guidance of the grinding belt, it is especially advantageous if the guidance is interrupted at the site of engagement of the grinding belt and is supplemented at this location by a profile roller which is rotatable about an axis and consists of an elastic material, preferably rubber. The grinding belt is protected by conducting it on the profile roller in the area of the site of engagement. Only static friction and not sliding friction occurs between the grinding belt and the profile roller. In particular, however, the grinding belt can be conducted in a roof-shaped manner by means of the profile roller in spite of the fact that it matches the edge profile. Persons skilled in the art have hitherto considered this to be impossible.

In conjunction with the roof-shaped guidance of the grinding belt by means of the profile roller, definite engagement of the grinding belt at the edges is achieved in response to the adjustment of the grinding belt unit if, in accordance with the invention, the axis of rotation of the profile roller is mounted approximately coaxially to the pivotal axis for the belt grinding unit disposed at the end of the pivotal arm.

It is advantageous for rotational manufacture if the device for clamping the formed part is arranged between two belt grinding units, each of which can be controlled separately. It is possible in this case to use the one belt grinding unit for coarse grinding and the other for precision grinding.

In view of the space required, it is favorable if the formed part and the belt grinding units are disposed in an approximately vertical upright plane. The machine in accordance with the invention thus requires only little space. Moreover, it is readily accessible for assembly and repair work and in particular for clamping the formed part into position. It is also well suited for mounting an effective exhaust hood.

In another advantageous further development of the invention, it is provided that the profile roller is mounted on a support and is acted upon by a substantially constant force in the direction of tool approach against the formed part, if necessary, swinging about the machining position as the zero position in the manner of a pendulum. Due to the substantially constant force a uniform processing force is achieved along the edge. The pendulum mounting of the profile roller makes it possible for the profile roller to give way and adapt itself in the case of inexactly clamped formed parts and, in this manner, to process the workpiece in the desired way in spite of the inexact clamping.

A preferred further development of the invention consists in that each belt grinding unit can have its pivotal position adjusted via a remote-control means by a copying roller which traces a guide template. This inventive control of the pivotal position of the belt grinding unit is advantageous in that it has a simple construction and is reliable in function. Due to the fact that a definite relationship between the pivotal position and the guide template is given via the remote-control means, it is possible to determine the associated guide template for formed parts with novel shapes in a simple, empirical manner. As the formed part is rotated through the belt grinding unit is brought into its optimum position and the corresponding position of the copying roller is recorded by marking it, for example, on a guide template blank. If the formed part is rotated piece-by-piece in this manner, points on the required guide template curve are obtained which can then be connected together to attain this curve. This work can even be done by untrained auxiliary personnel.

In order to be able to transfer the movement of the tracing roller to the belt grinding unit in a simple manner, it is favourable if the remote-control means has a resilient tension and pressure element which is moved with a minimum of friction in a support casing by means of balls. This remote-control means is advantageous, since it ensures a specific relationship between the position of the copying roller and the pivotal position of the belt grinding unit in spite of the many possible spacial positions of the belt grinding unit. Since the tension and pressure element is resilient, it can match any pivotal position of the belt grinding unit. The ball guidance inside the support casing ensures an easy and vibrationless displacement of the pressure element, thereby achieving a reliable following movement of the belt grinding unit.

The present invention also relates to a method for grinding the edge areas of formed parts. In accordance with the invention, the method is characterized in that the formed part is rotated between two belt grinding units, it coming into engagement during a first partial rotation with the coarse belt grinding unit and during another partial rotation with the precision belt grinding unit on the already coarsely ground edge, whereupon the coarse belt grinding unit is disengaged from the formed part after yet another partial rotation and after completion of the coarse grinding operation, while the precision grinding unit is also disengaged from said formed part after completion of the precision grinding operation.

If both belt grinding aggregates are disposed opposite one another, then it will be sufficient to rotate it through 540° about its own axis of complete processing of the formed part. The coarse belt grinding unit operates alone during the first half of the rotation of the form part. During the next rotation through 180° both belt grinding units are engaged with the formed part and during the last rotation through 180° only the precision grinding unit is engaged with the formed part. In this way the formed part is machined along its entire edge in a single clamping operation and during only one rotation of the formed part through 540°.

Figure 2:
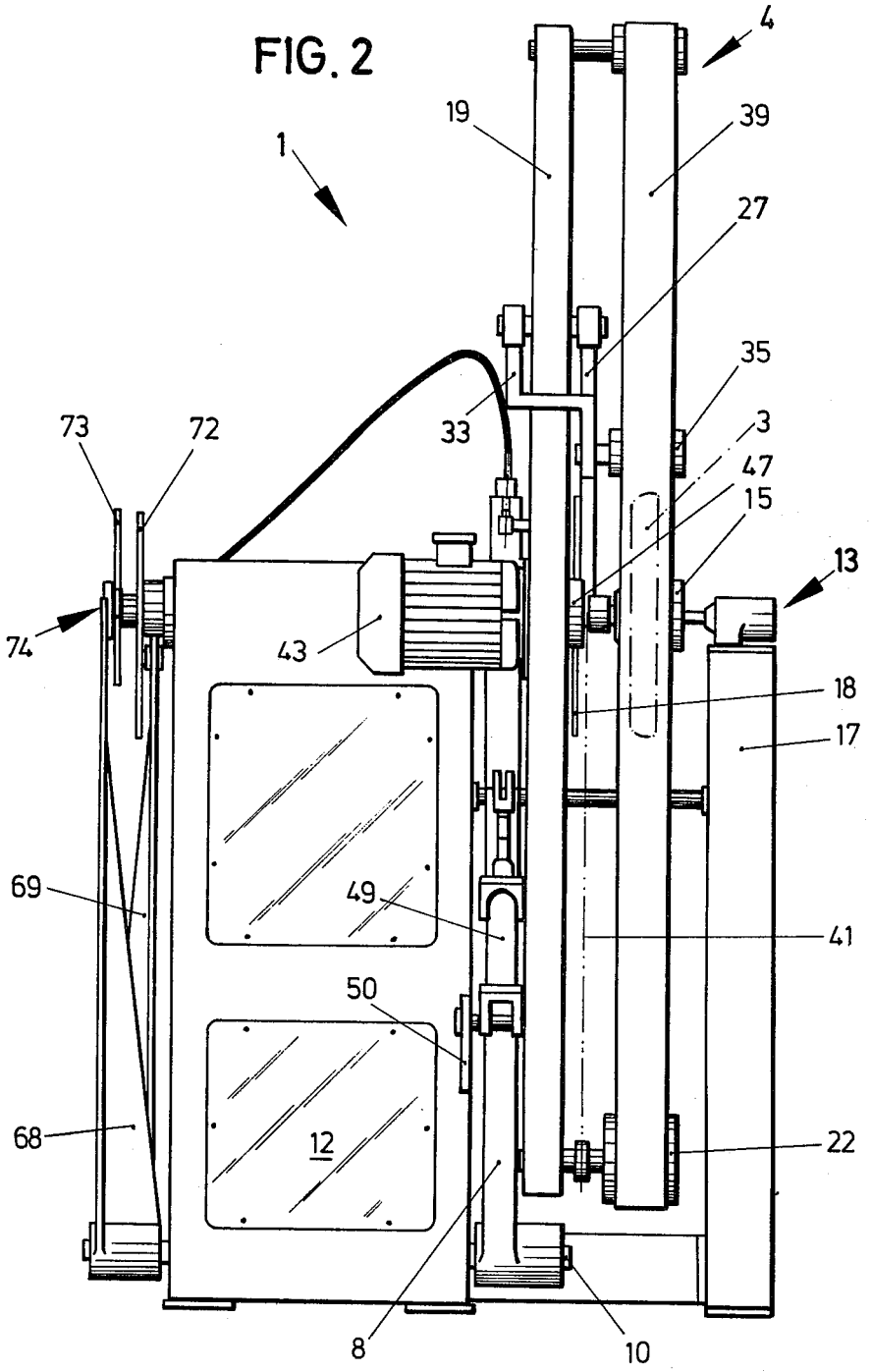
Figure 3:
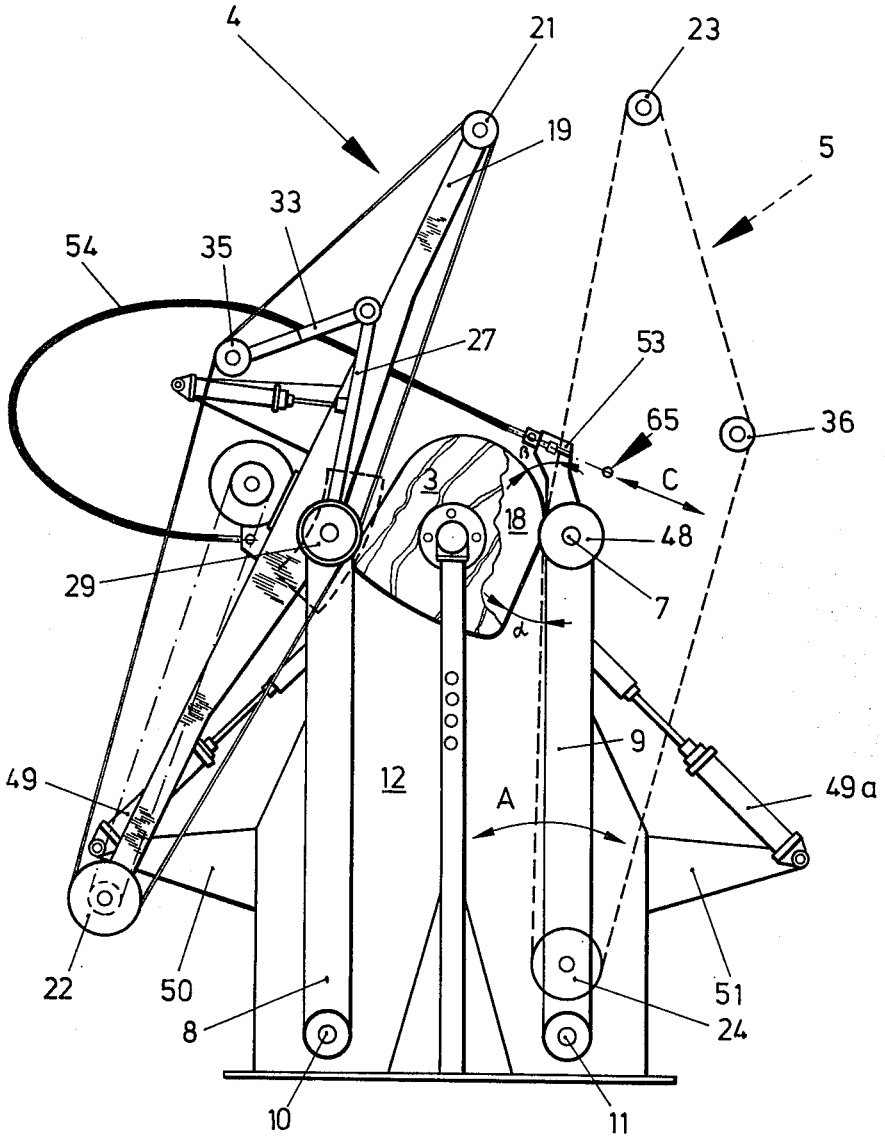
Figure 4:
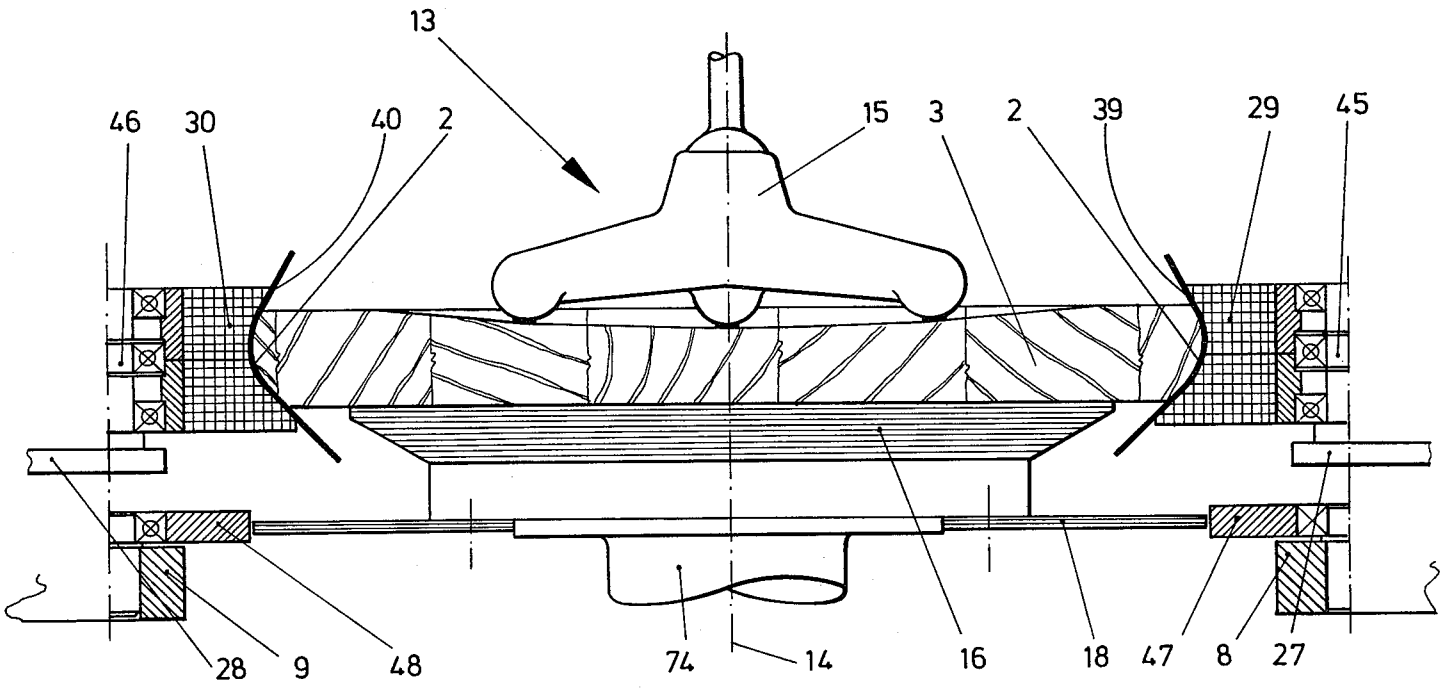
Figure 5:
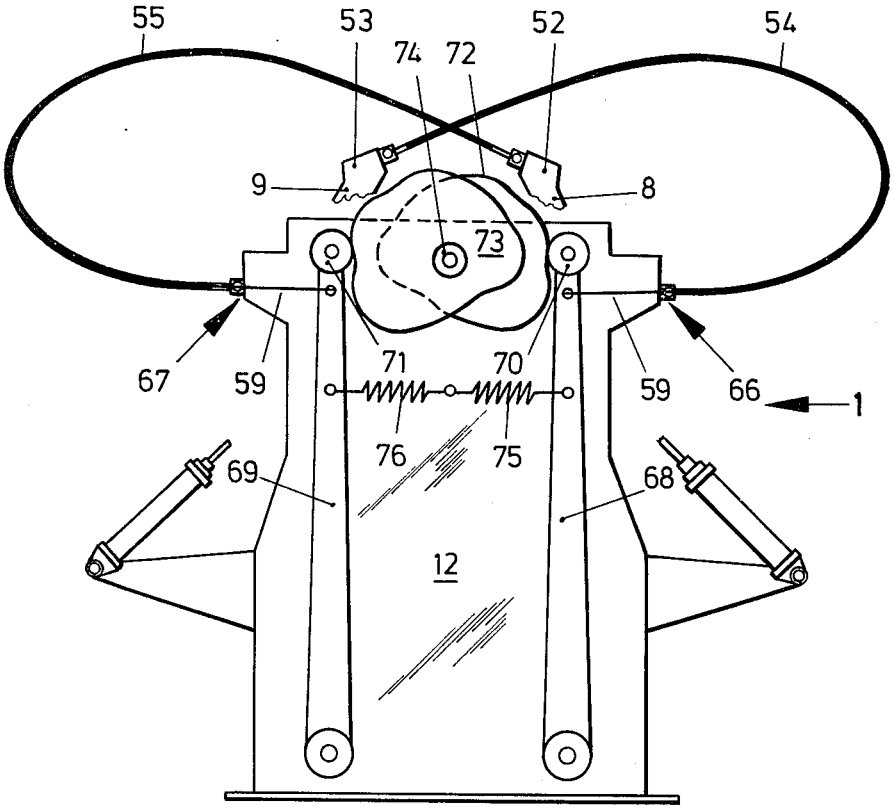
Figure 6:
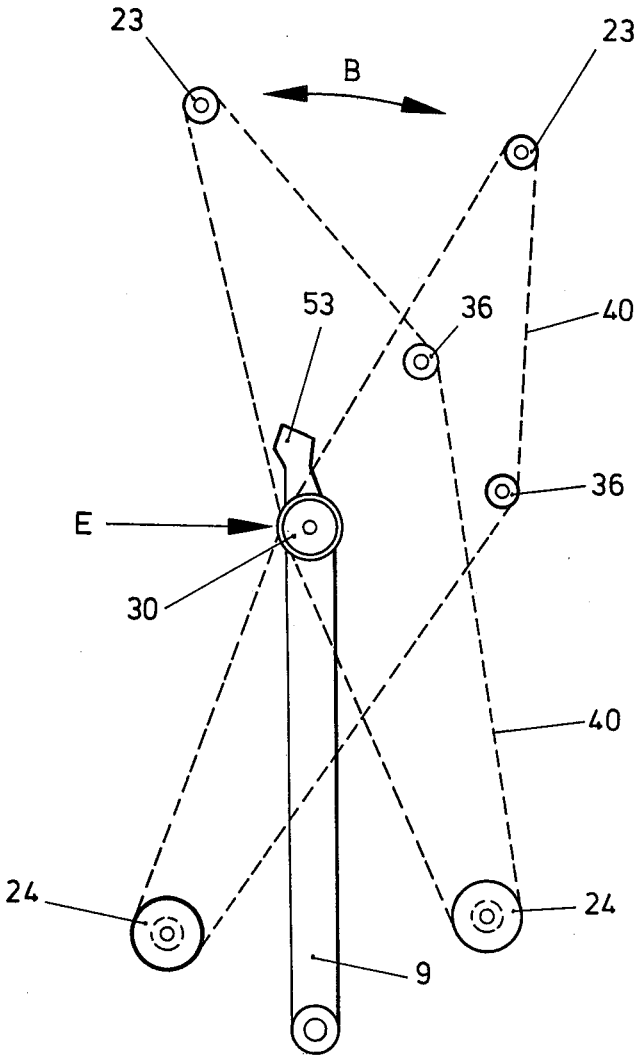
Figure 7:
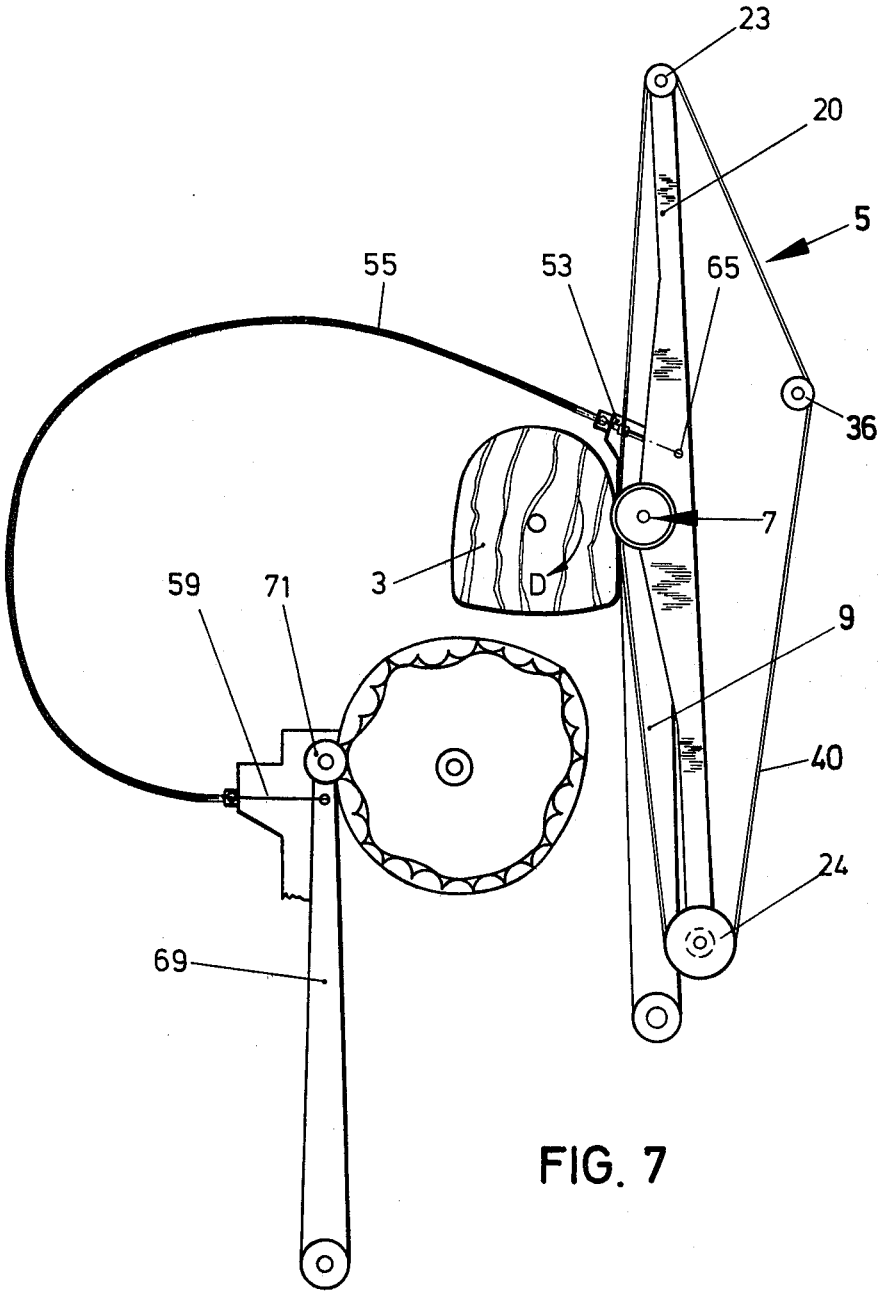

Embodiments of the invention are described in the following with reference to a drawing, in which:

FIG. 1 is a front elevation of a machine for grinding the edge areas of slab-shaped formed parts, FIG. 2 is a lateral elevation of the machine illustrated in FIG. 1, FIG. 3 is another front elevation of the machine illustrated in FIG. 1, however, in which the formed part is shown in another position and the right belt grinding unit is only shown schematically, FIG. 4 is a sectional elevation through a clamping device, FIG. 5 is a schematic rear elevation of the machine illustrated in FIG. 1, FIG. 6 is an illustration of a pivotal arm showing various positions of the belt grinding unit, FIG. 7 is a schematic sketch in which the production of a control template for controlling the pivotal arm is shown, FIG. 8 is a cross section through a remote-control means, FIG. 9*a-f* are top elevations of various formed parts.

Figure 11:
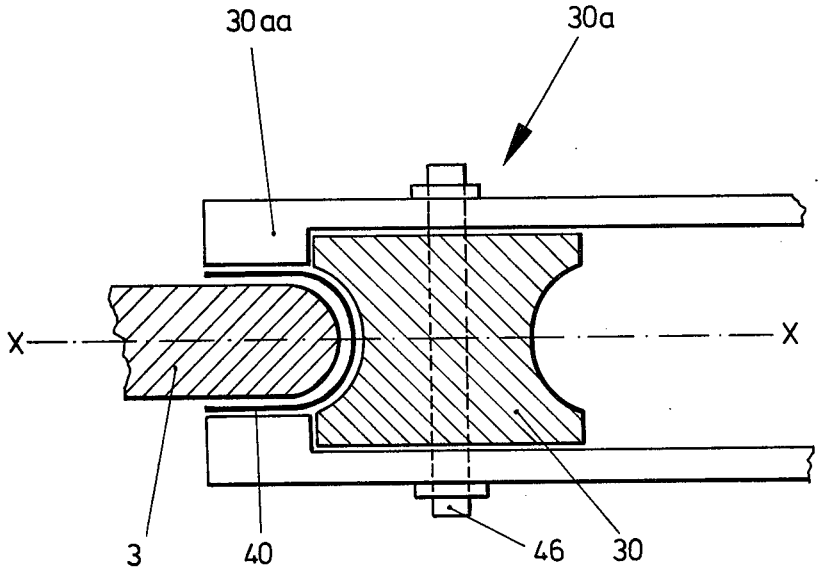

FIG. 10*a–i* are cross-sectional elevations through formed parts with different kinds of edges, and FIG. 11 is a cross section through a pressure shoe.

A machine 1 for grinding edge areas 2 of slab-shaped formed parts 3 is shown in FIG. 1 of the drawing. The machine has two belt grinding units 4 and 5 which are mounted with one axis 6 or 7 on the end portion of a pivotal arm 8 or 9 respectively, so as to be pivotal in a vertical plane.

The pivotal arms in turn are also mounted on the housing 12 of said machine 1 so as to be pivotal in a vertical plane about the axes of rotation 10 and 11.

In the present case, the formed part is the seat of a chair. It is clamped in a clamping device 13 in which it can be rotated about a substantially horizontal axis 14.

The clamping device is illustrated in more detail in FIG. 4. It can be seen clearly that the formed part 3 is clamped immovably between a pressure foot 15 and a workpiece support 16. As illustrated in FIG. 2, the pressure foot is mounted in a separate column 17 and can be moved in the direction of axis 14 in order to change the formed part. The workpiece support 16 is driven by a drive motor (not shown) whih is disposed in the housing 12 of the machine.

Directly behind the workpiece support a control template 18 is non-rotatably connected with the workpiece support and serves to control the pivotal movement of each pivotal arm 8 and 9. This will be discussed in more detail below.

FIG. 1 reveals that each belt grinding unit includes a support 19 or 20 at both free ends of which a reversal roller 21 and 22 or 23 and 24 is located. The support is pulled forward in a triangular manner in the area of the axes of rotation 6 and 7. The axis of rotation 6 or 7 is respectively located in the area of the apex of the triangle. In the case illustrated, a pivotal lever 27 or 28 is respectively disposed in the upper half on a substantially horizontal axis 25 or 26. A pressure element 29*a* or 30*a* is respectively arranged on the free end of said pivotal lever and is shown only by dotted lines in FIGS. 1 and 3 for the sake of clarity. It consists of a guidance with a U- or V-shaped cross section which is interrupted or discontinued at the point of engagement of said belt grinding unit and is supplemented there by a profile roller 29 or 30 which can rotate freely about an axis 45 or 46. The axes 45 and 46 are aligned coaxially relative to the axes of rotation 6 and 7 of the belt grinding units 4 and 5 in the illustrated case.

FIG. 11 is a schematic view of a pressure element 30*a* in cross section which is designed as a pressure shoe 30*aa* with a guidance which has a U-shaped cross section. The guidance is formed in a roof-shaped manner in the longitudinal section in the plane *x—x* indicated in FIG. 11. The profile roller 30 is arranged at the apex of the roof shape. Only the respective profile roller is shown in the other figures in order to simplify the drawing.

The one end of a cylinder-piston system 31, 32 is articulated on the two pivotal levers respectively while the other end thereof is firmly connected to the respective supports 19 and 20. These cylinder-piston systems are acted upon by compressed air and exert a substantially constant force on the respective pivotal arms.

Tension levers 33 and 34 are also mounted pivotally on the same axes 25 and 26. Freely rotatable reversal rollers 35 and 36 are located on the free ends of said tension levers. These tension levers are connected with the supports 19 and 20 via springs 37 and 38 respectively such that they are each pushed upwardly by the spring force out of the position shown in FIG. 1.

A grinding belt 39 or 40 is laid around the four rollers 21, 35, 22, 29 or 23, 30, 24 and 36, the first being a coarse grinding belt and the second being a precision grinding belt.

The reversal rollers 22 and 24 can be driven respectively by drive motors 43 or 44 via V-belts 41 or 42. Said motors are mounted on the corresponding supports 19 and 20.

FIG. 4 of the drawing shows a partial section through two profile rollers 29 and 30 in addition to the clamping device 13. It can be seen clearly that the profile rollers are respectively mounted on axes 45 and 46 with the aid of ball bearings. The profile rollers are of rubber and now have a substantially V-shaped cross section which matches the edge area 2 to be ground. The rollers form an elastic guidance for the respective grinding belt 39 or 40.

Furthermore, this figure also reveals tracing rollers 47 or 48 which are associated with a first control template 18 as already mentioned above and serve to control the pivotal movement of the pivotal arms 8 and 9 according to the design of the control template. The tracing rollers are mounted directly on the pivotal arms. These are acted upon by a substantially constant force via load cylinders 49 and 49*a* in such a manner that the tracing rollers 47 and 48 are always located in abutment with the control template. As FIG. 3 reveals, the load cylinders 49 and 49*a* are mounted for this purpose with one end respectively secured to a pivotal arm and with the other end secured to a support 50 or 51 which in turn is mounted on the housing 12.

In FIG. 3 of the drawing, the right belt grinding unit 5 is only indicated by dotted lines in order to better illustrate the pivotal arm 9. It is clearly evident that the control template 18 is positioned behind the formed part. Moreover it is clearly evident how the tracing roller 48 is connected to the pivotal arm and associated with the control template. The double arrow A indicates the possible pivotal movement of the pivotal arm about the axis 11.

FIGS. 1, 3 and 6 reveal that the respective grinding belt 39 or 40 is conducted in a roof-shaped or V-shaped manner through the profile roller 29 or 30 which is displaced outwardly with respect to the corresponding support 19 or 20. The profile rollers are located respectively at the tip of the V or roof shape. The type of grinding belt guidance just described above serves to make a linear-like operative engagement possible in the area of the profile roller.

The leg of the belt up to the profile roller forms an angle not less than 180° together with the leg of the grinding belt leading away from said profile roller.

FIG. 2 of the drawing reveals that the grinding belts of the belt grinding unit travel in the plane of rotation of the formed part. The units are also pivotal in this plane as is shown in particular in FIGS. 3 and 6. The pivotal arms 8 and 9, however, are pivotable in one plane in the present case which is parallel to the plane of rotation.

Reference has already been made in conjunction with FIG. 3 to the fact that the pivotal arms are mounted to be respectively pivotal in the direction of the double arrow A. FIG. 6 of the drawing clearly shows that each belt grinding unit is mounted to be pivotal in the direction of the double arrow B. This double pivotability, i.e. both of each pivotal arm as well as each belt grinding unit on said pivotal arm, serves to ensure an optimum adjustment of each belt grinding unit with respect to the shape of the formed part. In order to achieve a definite and clean operative engagement of the respective grinding belt on the formed part, an attempt is made when machining the rotating formed part 3 that the angle $\alpha$ between the edge 2 and the leg of the grinding belt extending up to the profile roller is substantially equal to the angle $\beta$ between the edge 2 of the formed part and the leg of the grinding belt extending away from said profile roller. The two angles are shown next to the pivotal arm 9 in FIG. 3 of the drawing.

Due to the fact that the belt grinding unit is mounted in its entirety on the pivotal arm in one axis which is coaxial with respect to the axis of rotation of the respective profile roller, it is achieved in an advantageous manner that the operative engagement of the profile roller occurs at the same location even when the entire belt grinding unit is pivoted. This is clearly evident in FIG. 6. The site of operative engagement is indicated by an arrow E.

FIGS. 1, 3, 5 and 7 reveal that the free end 52, 53 of each pivotal arm 8, 9 has an offset design and is respectively connected with a separate remote-control means 54, 55.

A cross section through a remote control means is shown in FIG. 8 of the drawing. It includes a resilient support casing 56 in which a tension and pressure element 59 is located which is supported by means of balls 57 and 58 so as to operate with a minimum of friction. This tension and pressure element has a bar-shaped design and consists of metal. The balls are guided on the one hand in sheet metal strips 60 and 61 which respectively have bent-out openings for the balls and thus serve as a cage for them. Between said balls and the support casing, bands 62 and 63 with a cresent-shaped cross section are located which also have grooves for guiding the balls just like the tension and pressure element. The remote-control means just described above can be positioned in three spacial planes and has the advantage that it executes completely vibrationless control movements with precision.

In the present case, the support casing 56 is secured at its one end of the offset end 52 and 53 of the pivotal arms, whereas the tension and pressure element is firmly connected to the supports 19 and 20 at a location 64 or 65.

Observing FIG. 5 will reveal that the remote-control means 54 and 55 together with the respective support casings are firmly connected to the housing 12 at sites 66 and 67, while the end of the tension and pressure means 59 is articulated on two copying roller levers 68 and 69. The copying roller levers are respectively mounted on the housing to be pivotal in a vertical plane on axes coaxial with respect to axes 10 and 22. They support at their free ends copying rollers 70 and 71 which are respectively associated with guide templates 72 and 73. FIG. 2 reveals that the two guide templates are located in back of one another on a common shaft 74 and are non-rotatably connected thereto. The shaft as well as the workpiece support 16 and the control template 18 are driven by the motor disposed in the housing. In the present case, both the two guide templates 72 and 73 as well as the control template 18 and the workpiece support 16 are non-rotatably disposed on this one shaft 74.

The two copying roller levers 68 and 69 are acted upon by springs 75 and 76 in the direction of tool approach. One respective end of said springs is secured to the frame.

If the two copying rollers follow the contour of the guide templates during their rotation, the copying roller levers 68 and 69 are pivoted about their axes of rotation. The result is that the respective tension and pressure element 59 is displaced within the support casing and produces at the other end of the remote-control means a displacement of the belt grinding units in the manner indicated in FIG. 6 for example. The movement of the tension and pressure element of the remote-control means 54 is indicated by the double arrow C in FIG. 3.

Figure 9A:
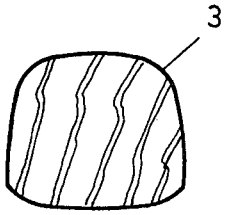
Figure 9B:
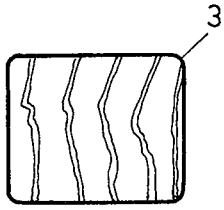
Figure 9C:
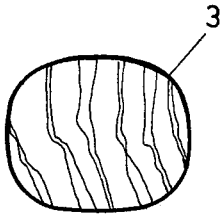
Figure 9D:
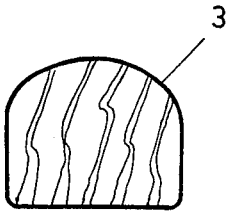
Figure 9E:
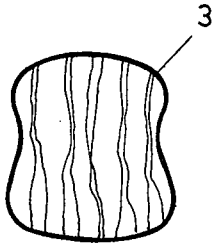
Figure 9F:
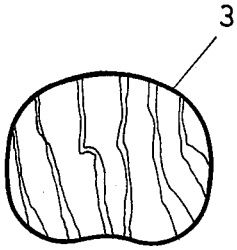

The machine in accordance with the invention is capable of machining the entire edge of slab-shaped formed parts in one work cycle and in one clamping operation. The formed parts may consist of wood, light-weight metal, plastic, cardboard or similar grindable materials. In the present case, the mode of operation of the machine is to be described in conjunction with the processing of a chair seat for a wooden chair. A few possible shapes of such chair seats are shown in FIG. 9. While formed parts are illustrated in FIGS. **9*a*–9*d* whose edges are either convex or straight, two formed parts are shown in FIGS. 9*e* and 9*f*** whose edges also have concave areas which thus recoil with respect to neighboring areas. All of the formed parts shown can be processed on the machine in accordance with the invention.

Various edge profiles of the formed parts are illustrated in FIG. 10 of the drawing. In order to process them, pressure elements are provided which correspond to their contours.

At the beginning of each processing operation, a formed part is inserted into the clamping device 13 which leaves the edge areas of the formed parts free. It is secured there to correspond to the position of the control template 18. After the formed part has been mounted between the workpiece support 16 and the pressure foot 15 so that it cannot slip, the formed part is set in rotation by the drive motor, e.g. in the direction of the arrow D in FIG. 1. First of all, the coarse belt grinding unit 4, which is already in operation, is brought into engagement with the formed part by pivoting the pivotal arm 8 inwardly. The coarse grinding belt 39 runs in the direction of arrow F. The coarse grinding belt thus moves in a direction opposite the passing edge 2 of the formed part 3 in the area of the profile roller 29.

The correct position of the pivotal arm 8 is determined with the aid of the control template 18 and the tracing roller 47. The control template travels uniformly together with the formed part about the required pivotal position of the belt grinding unit 4 and is controlled with the aid of the remote-control means 55, the copying roller 71 and the guide template 73. The support 19 is pivoted in such a manner that the leg extending up to the profile roller 29 and the adjacent edge of the formed part forms substantially the same angle as the leg extending away from the profile roller and the adjacent edge of the formed part.

After the formed part has executed a partial rotation of 180° and the already coarsely ground edge now reaches the operational area of the precision belt grinding unit, this is also energized and brought into engagement with the formed part by pivoting the pivotal arm 9 inwardly. During the partial rotation through 180° which now follows, both belt grinding units process the formed part simultaneously. The coarse belt grinding unit is then disengaged from the formed part again, since the entire edge of the formed part has been ground coarsely during one full rotation. After another rotation through 180° after de-energization of the coarse grinding belt unit, the precision grinding belt unit is also disengaged. The formed part has now finished the processing.

FIG. 4 depicts the situation in which both belt grinding unis are engaged and both profile rollers press the respective grinding belt tightly against the formed part so that effective machining can take place. The figure also reveals that the formed part is ground by the respective grinding belts over the entire curved edge area.

In order to achieve processing in the opposite direction, the precision grinding belt 40 is driven in the direction of the arrow G illustrated in FIG. 1.

The respective pivotal position of the precision belt grinding unit is controlled via the remote-control means 54, the copying roller 70 and the guide template 72.

Both pivotal arms 8 and 9 are acted upon during machining by the load cylinders 48 and 49 with a uniform force so that the tracing rollers 47 and 48 abut reliably on the control template 18.

The same applies for the pivotal levers 28 which are acted upon by the cylinder-piston systems 31 and 32 with such a uniform force that they abut reliably with their grinding belts on the formed parts.

Both the load cylinders as well as the above-mentioned cylinder-piston systems are acted upon with compressed air by a line system (not shown). The cylinder-piston systems act like springs and permit the pivotal levers 27 and 28 to be able to swing back and forth about a zero position like a pendulum to compensate for errors. Minor clamping errors are compensated for in this manner.

Due to a modified setting of the cylinder-piston systems 31 and 32, it is also possible to move the profile roller outwardly to a greater or lesser extent and thus alter the V-shaped or roof-shaped guidance of the two grinding belts. This can ultimately result in that the grinding belt is conducted in a straight line between the two reversal rollers 23 and 24 or 21 and 22 at its processing site. Such a guidance is feasible, for example, for processing a formed part according to FIG. **9*c*. In order to process the formed parts illustrated in FIGS. 9*a* and 9*f***, the roof-shaped guidance is necessary, however, since the concave edge areas can not otherwise be processed.

The grinding belts are always kept under tension by the reversal rollers 35 and 36 located on the tension levers 33 and 34.

In the following, the production of one of the two guide templates 72 or 73 shall be explained.

It has already been stated that when pivoting a belt grinding unit through the specified control transfer of the remote-control means, a specified movement of the corresponding copying roller lever also ensues. This effect is utilized to produce the guide templates.

If the formed part shown in FIG. 7 is rotated in the direction of the arrow D step-by-step and if the belt grinding unit is set in an optimum manner every time the formed part stops so that the angle $\alpha$ shown in FIG. 3 is approximately equal to angle $\beta$, the result is that the copying roller 71 is deflected accordingly on the rear side of the housing. If the respective position of the copying roller is marked on a guide template blank and if the respective vertexes of the marks are connected with one another, the result is a curve which exactly represents the required control curve for the pivotal movements of the belt grinding unit for the corresponding formed part.

The guide template can then be produced in accordance with the resultant mark. The other guide templates are produced in an analogous manner.

The invention is not limited to the embodiments shown. It is also possible, for instance, to design the pressure element as a pressure shoe without a profile roller or as an independent profile roller without a pressure shoe. Furthermore, it is also possible to install an exhaust hood above the machine to remove the grinding dust.

I claim:

1. A machine for grinding the edge areas of slab formed parts comprising a frame, means carried by said frame for clamping the formed part in a manner leaving its edge areas free and for rotating the formed part about an axis in a plane substantially normal to said axis, a grinding unit carried by said frame including guide rollers and a grinding belt conducted over said guide rollers, a pressure element carried by said frame having a cross section generally matched to the edge area to be ground, means carried by said frame including said pressure element for pressing said grinding belt against the formed part, an arm carried by said frame for pivotal movement in a plane parallel to the plane of rotation of the formed part, means mounting said grinding unit for pivotal movement on said arm and about an axis of rotation generally parallel to the pivotal axis of said arm so that said belt grinding unit can be pivoted about its axis of rotation in the plane of rotation of the formed part, and means for adjusting the direction of approach of the grinding belt in accordance with the rotational position of the formed part such that the angles formed by the belt and the formed part as the belt approaches and leaves the formed part are generally equal one to the other.

2. A machine according to claim 1 wherein said pressure element is displaced in a direction toward the formed part and said grinding belt forms an angle less than 180° as it engages the formed part at a location between said pressure element and the formed part.

3. A machine according to claim 1 wherein said pressure element includes a guide which is interrupted at the site of engagement of the grinding belt and the formed part, a rotatable profile roller carried by said guide at the location of the engagement between the grinding belt and the formed part, said roller being formed of an elastic material.

4. A machine according to claim 3 wherein the axis of rotation of the profile roller is substantially coaxial with respect to the axis of rotation of said belt grinding unit on said pivotal arm.

5. A machine according to claim 1 including a second grinding unit carried by said frame in opposition to the first mentioned grinding unit, said clamping means being disposed between said first and second belt grinding units.

6. A machine according to claim 5 wherein the formed part and said first and second belt grinding units are disposed in a substantially common vertically disposed plane.

7. A machine according to claim 1 including a control template carried by said frame, a control roller carried by said arm for tracing the edge of said control template, means for urging the control roller into engagement with said control template to maintain said arm in predetermined positions in accordance with said control template, said adjusting means including a guide template, a movable member carrying a roller for tracing the edge of said guide template, and means for transmitting the movement of the member carrying the tracing roller as it traces along the guide template to said grinding belt to angularly adjust said grinding unit about the pivotal axis and about the formed part.

8. A machine according to claim 7 wherein said transmitting means includes a flexible element, a support casing for said flexible element, a plurality of balls carried by said support casing for enabling said flexible element to move within said support casing with minimal friction.

9. A machine according to claim 1 including a support, said profile roller being carried by said support, means for applying a substantially constant force to said profile roller to bias it in a direction toward the formed part.

10. A machine according to claim 1 wherein said pressure element is displaced in a direction toward the formed part and said grinding belt forms an angle less than 180° as it engages the formed part at a location between said pressure element and the formed part, said pressure element including a guide which is interrupted at the site of engagement of the grinding belt and the formed part, a rotatable profile roller carried by said guide at the location of the engagement between the grinding belt and the formed part, said roller being formed of an elastic material.

11. A machine according to claim 1 including a control template carried by said frame, a control roller carried by said arm for tracing the edge of said control template, means for urging the control roller into engagement with said control template to maintain said arm in predetermined positions in accordance with said control template, said adjusting means including a guide template, a movable member carrying a roller for tracing the edge of said guide template, and means for transmitting the movement of the member carrying the tracing roller as it traces along the guide template to said grinding belt to angularly adjust said grinding unit about the pivotal axis and about the formed part, said pressure element being displaced in a direction toward the formed part and said grinding belt forming an angle less than 180° as it engages the formed part at a location between said pressure element and the formed part, said pressure element including a guide which is interrupted at the site of engagement of the grinding belt and the formed part, a rotatable profile roller carried by said guide at the location of the engagement between the grinding belt and the formed part, said roller being formed of an elastic material, and the axis of rotation of the profile roller being substantially coaxial with respect to the axis of rotation of said belt grinding unit on said pivotal arm.

12. A machine according to claim 1 including a second grinding unit carried by said frame in opposition to the first mentioned grinding unit, said clamping means being disposed between said first and second belt grinding units, said second grinding unit including guide rollers and a grinding belt conducted over said guide rollers, a second pressure element carried by said frame having a cross section generally matched to the edge area to be ground generally opposite to the edge area to be ground by said first grinding unit, means carried by said frame including said pressure element for pressing the grinding belt of said second grinding unit against the formed part, a second arm carried by said frame for pivotal movement in a plane parallel to the plane of rotation of the formed part, means mounting said second grinding unit for pivotal movement on said second arm and about an axis of rotation generally parallel to the pivotal axis of said second arm so that said second belt grinding unit can be pivoted about its axis of rotation in the plane of rotation of the formed part, and means for adjusting the direction of approach of the grinding belt of the second grinding unit in accordance with the rotational position of the formed part such that the angles formed by the latter belt and the formed part as the latter belt approaches and leaves the formed part are generally equal one to the other.

13. A machine according to claim 12 wherein said second pressure element is displaced in a direction toward the formed part and the grinding belt of said second grinding unit forms an angle less than 180° as it engages the formed part at a location between said second pressure element and the formed part.

14. A machine according to claim 12 wherein said second pressure element includes a guide which is interrupted at the site of engagement of the grinding belt of the second grinding unit and the formed part, a second rotatable profile roller carried by said guide at the location of the engagement between the grinding belt of the second grinding unit and the formed part, said second roller being formed of an elastic material.

15. A machine according to claim 14 wherein the axis of rotation of the second profile roller is substantially coaxial with respect to the axis of rotation of said second belt grinding unit on said second pivotal arm.

16. A machine according to claim 12 wherein the formed part and said second belt grinding units are disposed in a substantially common vertically disposed plane.

17. A machine according to claim 12 including a control template carried by said frame, a pair of control rollers carried by the respective arms for tracing the edge of said control template, means for urging the control rollers into engagement with said control template to maintain the respective arms in predetermined positions in accordance with said control template, said adjusting means including a guide template, a pair of movable members each carrying a roller for tracing the edge of said guide template, and means for transmitting the movement of the members carrying the tracing rollers as they trace along the guide template to the respective grinding belts to angularly adjust said first and second grinding units about their respective pivotal axes and about the formed part.

18. A machine according to claim 17 wherein said transmitting means includes at least one flexible element, a support casing for said flexible element, a plurality of balls carried by said support casing for enabling said flexible element to move within said support casing with minimal friction.

19. A machine according to claim 1 wherein said pressure element is carried by said mounting means.

* * * * *